United States Patent [19]

Davis

[11] Patent Number: 4,831,240

[45] Date of Patent: May 16, 1989

[54] ELECTRICAL HIGH CURRENT INDUSTRIAL OVEN OR FRYER COMPRESSION CONNECTION

[75] Inventor: Kenneth F. Davis, Walnut Creek, Calif.

[73] Assignee: Hester Industries, Inc., Moorefield, W. Va.

[21] Appl. No.: 105,676

[22] Filed: Oct. 8, 1987

[51] Int. Cl.[4] ..... H05B 3/08

[52] U.S. Cl. ..... 219/539; 174/94 R; 219/541

[58] Field of Search ..... 219/539, 541; 439/819, 439/822; 174/94 R; 361/310; 338/332

[56] References Cited

U.S. PATENT DOCUMENTS

| | | | |
|---|---|---|---|
| 1,616,067 | 2/1927 | Somes | 219/539 |
| 2,724,039 | 11/1955 | McCullough | 219/541 |
| 2,961,522 | 11/1960 | Hammer | 219/541 |
| 3,001,173 | 9/1961 | Swengel | 439/822 |
| 4,015,328 | 4/1977 | McDonough | 174/94 R |

FOREIGN PATENT DOCUMENTS

| | | | |
|---|---|---|---|
| 250099 | 4/1926 | United Kingdom | 361/310 |
| 1157052 | 7/1969 | United Kingdom | 219/541 |
| 1333741 | 10/1973 | United Kingdom | 174/94 R |
| 1417547 | 12/1975 | United Kingdom | 174/94 R |

OTHER PUBLICATIONS

Sonoweld Equipment for Ultrasonic Welding, Bulletin 118, Sonobond Corp., Nov. 1958.

Leedy, R. M., "Aluminum in the Electrical Industry", Westinghouse Engineer, May 1953, pp. 98–102.

*Primary Examiner*—Teresa J. Walberg

*Attorney, Agent, or Firm*—Nixon & Vanderhye

[57] ABSTRACT

Industrial electric ovens and fryers of the type used for cooking precooked foods such as meats prior to packaging of the food draw high currents which tend to melt internal electrical connections. An industrial heating device includes compression-type electrical connections which reliably carry high currents and are capable of withstanding high voltage levels without breaking down. Compression-type electrical connections are used instead of the screw-type connections of the prior art to insure that all electrical connections have reliable, relatively large current-carrying cross-sectional contact areas. The electrical connection matrix of the resulting industrial heating device has increased current-carrying capacity and is much more reliable and resistant to electrical failure.

17 Claims, 7 Drawing Sheets

FIG. 2A
PRIOR ART
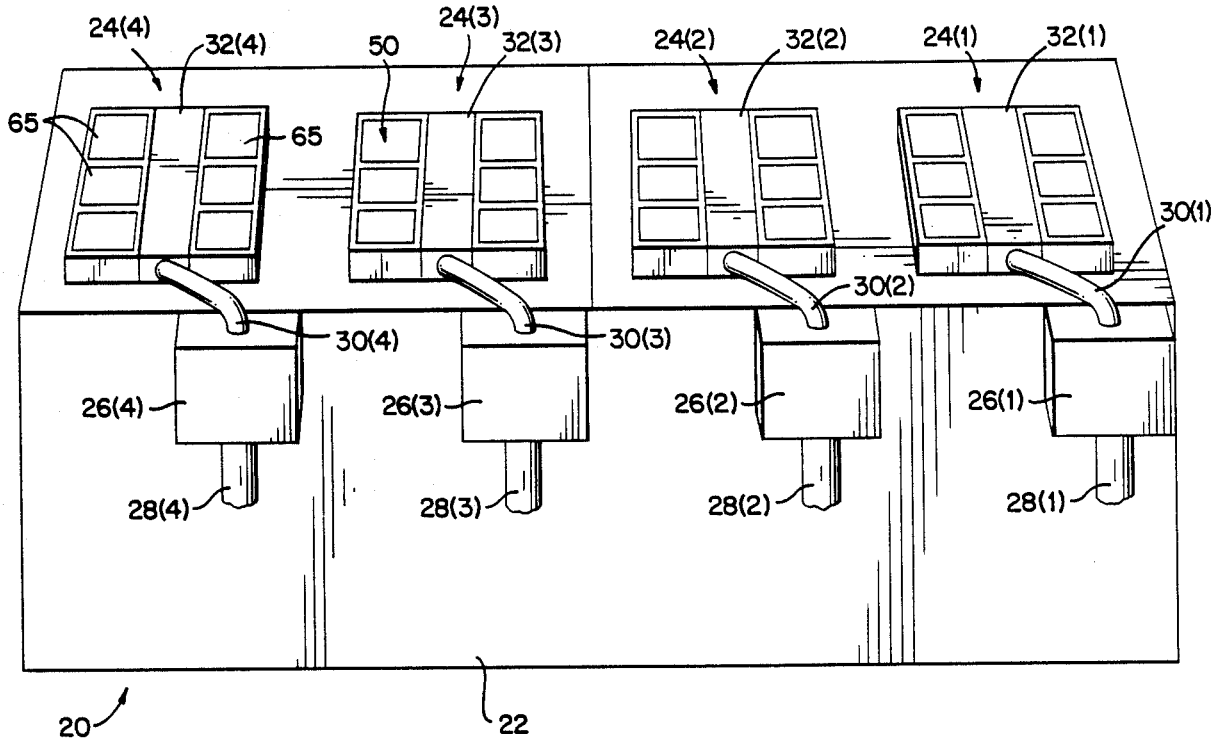
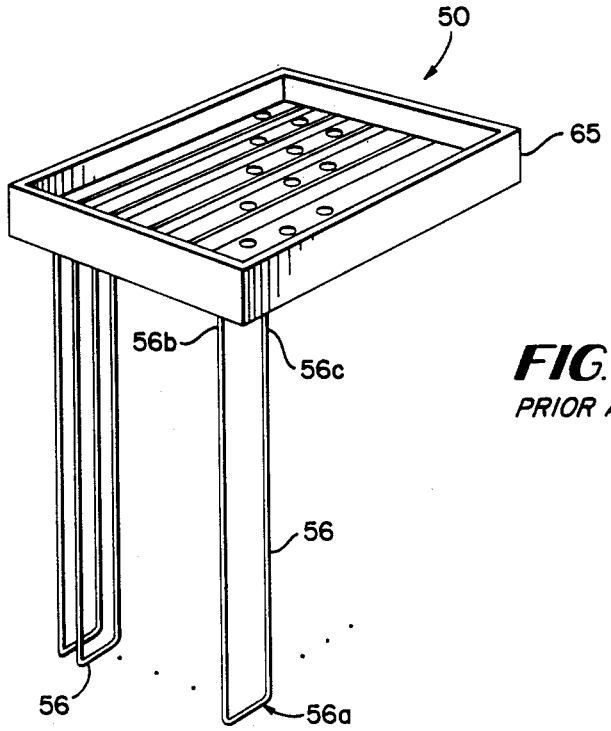
FIG. 2B
PRIOR ART

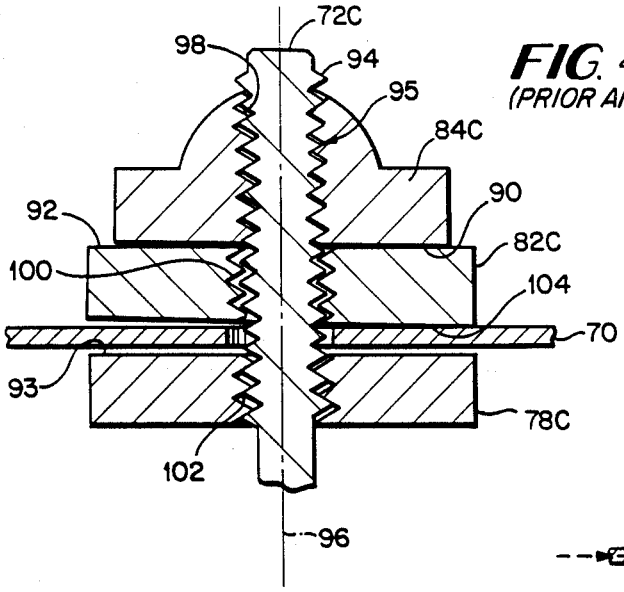
FIG. 4A
(PRIOR ART)
FIG. 5A
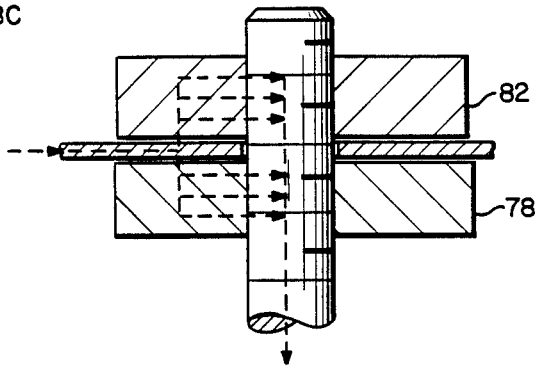
FIG. 7
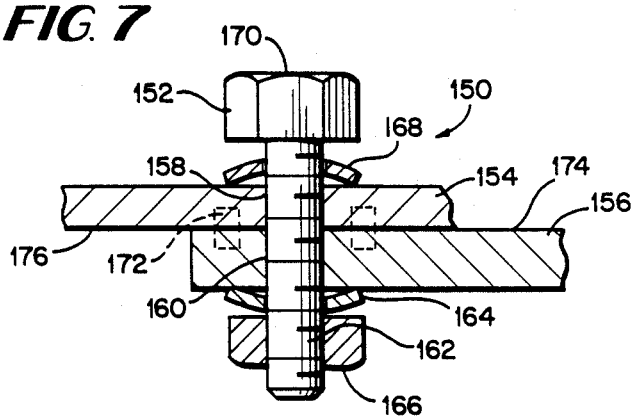
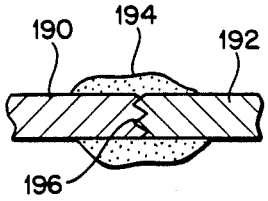
FIG. 8
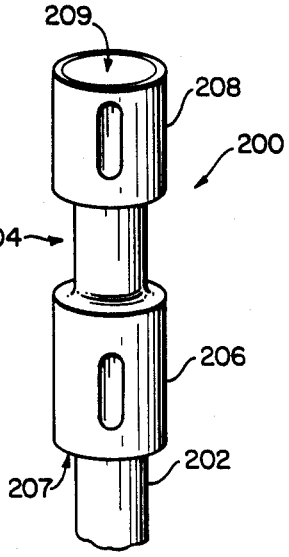
FIG. 9A
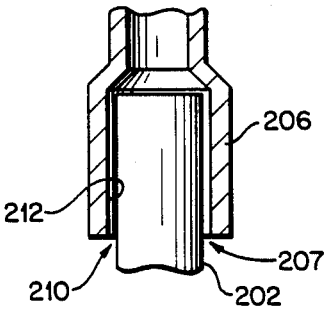
FIG. 9B FIG. 10
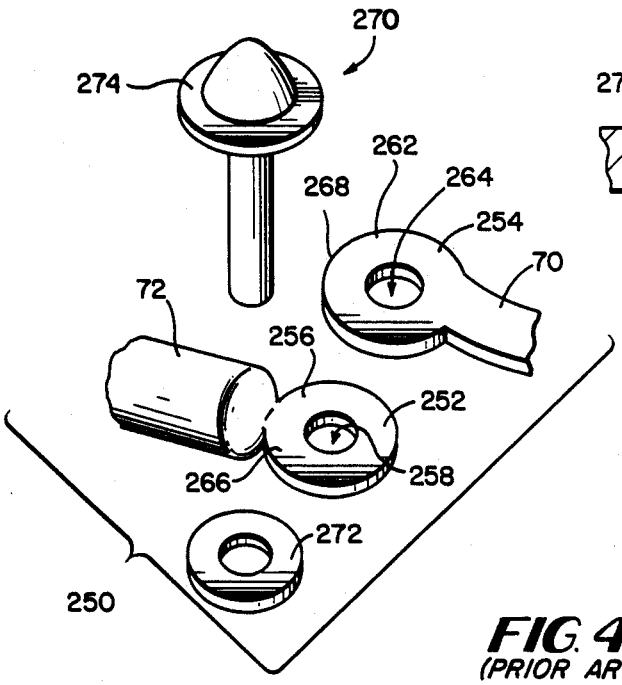
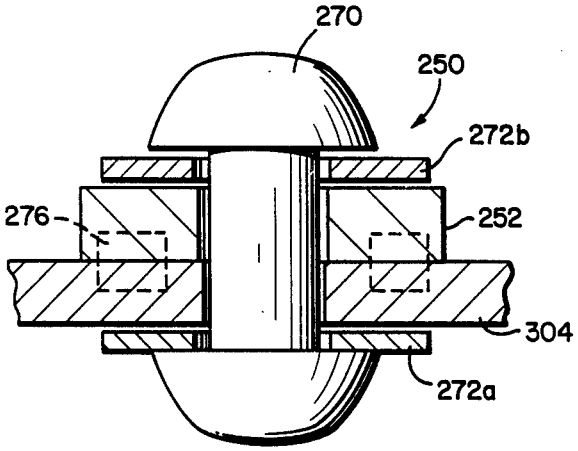
FIG. 10A
FIG. 4B
(PRIOR ART)
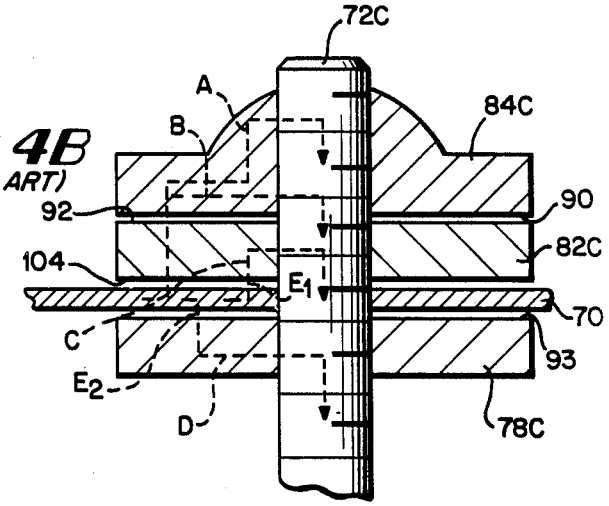
FIG. 5
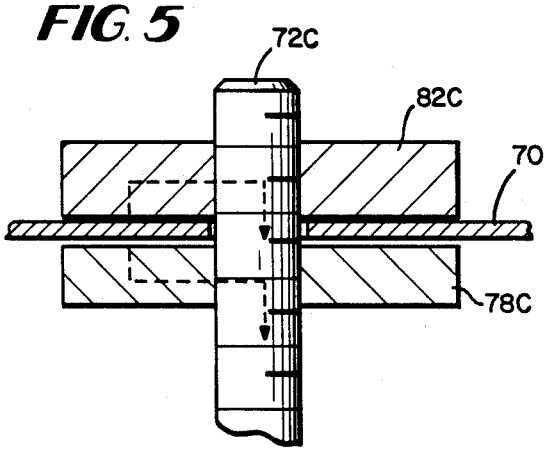
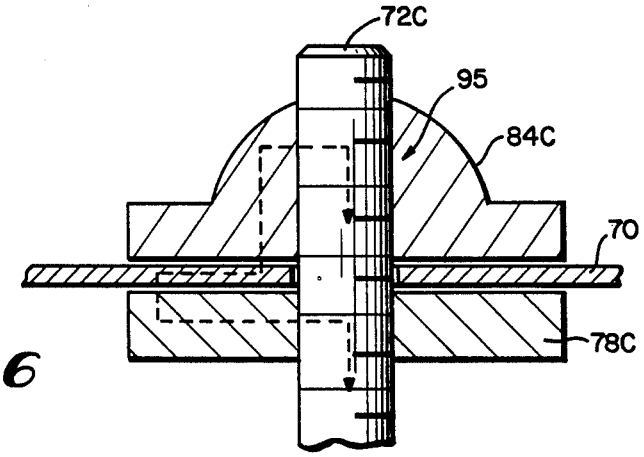
FIG. 6

ELECTRICAL HIGH CURRENT INDUSTRIAL OVEN OR FRYER COMPRESSION CONNECTION

FIELD OF THE INVENTION

The present invention relates to electrical heating apparatus, and more particularly to electrical ovens and fryers. Still more particularly, the present invention relates to industrial ovens and fryers including high current electrical compression connections for connecting the electrical heating elements to an AC power bus bar.

BACKGROUND OF THE INVENTION

It is critical that industrial electrical food heating and cooking devices such as ovens and fryers operate efficiently and reliably under nearly continuous usage over long time periods. Many such devices in the past operated at relatively low power levels, so that even non-optimum internal electrical connection arrangements did not present significant problems. In many industrial applications (e.g., preparation of precooked food products), however, heating devices which can elevate the temperature of heating chambers rapidly are required. Such heating devices may draw large amounts of electrical power (e.g., 10 kilowatts per heating element array). Unless industrial heating device electrical connections are properly designed, such large current levels can cause the connections to fail in a variety of modes, some of which present hazards to human life.

FIG. 1 is a schematic diagram of a typical "wye" connected oven heater element matrix 50 for connection to a three-phase, 450 VAC power source.

Heater element matrix 50 includes three heater element sub-matrices 52*a*, 52*b* and 52*c*, each sub-matrix being connected to a different phase of the 3-phase power source. Each sub-matrix 52 includes two columns 54 of heater elements, each column including five individual heater elements 56. All elements 56 are connected between common neutral bus bar 58 and a "hot" phase terminal 60 (one "hot" terminal being connected to each of the three incoming power line phases).

In the prior art arrangement shown in FIG. 1, each phase terminal 60*a*–60*c* is connected to ten parallel heating elements 56, and each heating element has a 100 watt power rating. The nominal voltage between each phase terminal 60*a*–60*c* and neutral bus 58 is 277 VAC, and each heating element 56 draws about 3.6 amps. Accordingly, each phase terminal 60*a*–60*c* supplies about 36 amps at 277 volts—or about 10,000 watts.

FIG. 2 is a perspective view of a prior art heater element matrix 50 corresponding to the FIG. 1 electrical connection diagram. In the FIG. 2 arrangement, electrical connections are established between phase terminals 60*a*–60*c* and heater elements 56 (the heater elements being hidden from view inside housing 65 shown in FIG. 2). An array or grid of parallel strip conductors 70 connects phase terminals 60*a*–60*c* and neutral bus bar 58 to respective heater element terminals 57.

FIG. 2A shows a prior art oven 20 of the type adapted to use heater element matrices 50. Oven 20 includes a hood 22 defining a chamber therein. A moving belt for supporting items to be heated is disposed within the chamber. In the embodiment shown, four banks or "zones" 24(1)–24(4) of six heater element matrices 50 each are installed in hood 22 to heat the air within the chamber to very high temperatures. Electrical connection boxes 26(1)–26(4) are each supplied with incoming power line "phases" from a main controller (not shown) of conventional design' via conduits 28(1)–28(4). Further conduits 30(1)–30(4) enclose insulated cables which connect connection boxes 26(1)–26(4) to branch panel boxes 32(1)–32(4). Branch panel boxes 32(1)–32(4) in turn supply three phase power to each of the matrices 50 in banks 24(1)–24(4), respectively. Boxes 26 and 32, conduits 28 and 30 and matrix enclosures 65 are preferably made of conductive material (e.g., steel or aluminum) and are mutually connected together and to a common grounding point—all as well known to those skilled in this art. Enclosures 65 each include a cover 34 which protects operators from shock and exposure to the electrical connections within.

FIG. 2B is a perspective view of a heater element matrix 50. In the embodiment shown, heater elements 56 are elongated tubular structures having a loop portion 56*a* shaped as a letter "U" and terminating in two end portions 56*b*, 56*c*. These conventional heater elements 56 include an outer tubular shell enclosing a drawn high resistance conductor which insulative material prevents from contacting the shell. When AC current is connected across element 56, the element internal high resistance conductor emits heat which is then radiated by the element tubular shell. Element end portions 56*b*, 56*c* terminate in the terminals 57 shown in FIG. 2.

FIG. 3 shows a more detailed view of a single connection strip 70 and the manner in which that connection strip is connected to five heater element terminals 57*a*–57*e*.

In the prior art arrangement shown in FIG. 3, each heater element terminal 57 includes an insulating spacer 74 having a longitudinal cylindrical passage formed axially therethrough, and a threaded cylindrical post 76 passing through the spacer passage. The portion of threaded post 76 protruding from the top of spacer 74 is used as a connection terminal post 72 to connect corresponding heater element 56 with connection strip 70. A conventional metallic nut 78 has threads which are engaged with the threads of post 72. Spacer 74 is preferably mounted on a flat supporting insulative surface (not shown), and the lower end of post 76 (as shown in FIG. 3) connects with (and mechanically supports) heater element 56.

Connection strip 70 is a conductive (e.g., nickel copper), relatively thin elongated flat bar having five holes 80 drilled therethrough at regular intervals along the length of the strip. Terminal posts 72 are passed through respective holes 80, and nuts 82 are threaded onto the posts. Nuts 82 are tightened until strip 70 is firmly held in place between nuts 78, 82—establishing an electrical connection between the strip and the opposing nuts. Some current may flow between the strip 70 and terminal post 72 via the threads of the post which happen to contact the strip, but most of the current flow is through the nuts which contact both the strip and the post. A conventional threaded locknut 84 is engaged with terminal post 72 above nut 82 and is tightened to prevent nut 82 from loosening.

The FIG. 2 connection matrix 50 suffers from the disadvantage that most or all of the current flow to/-from heating elements 56 is through threads of nuts 78, 82, 84 which engage the threads of terminal posts 72. This arrangement is adequate only if the current drawn by the heater elements and the voltages applied to phase terminals 60 are relatively small. However, a modern industrial oven has a large heating chamber which requires a substantial amount of heating power to be rapidly elevated to operating temperature and to be maintained at nearly constant, high temperature levels despite variations in chamber heat loading. Consequently, arrangements such as those shown in FIGS. 2 and 3 have been (improperly) used in the past to provide 10,000 watts of energy from each of these phases of input AC voltage. These prior art arrangements experience relatively high failure rates when used continuously in production environments. Some of the failure modes these arrangements exhibit are potentially dangerous to human operators, and all failure modes increase production plant down time and add to plant maintenance and repair costs.

I have discovered that most of the failure modes of the FIG. 2 and 3 arrangements are caused by the threaded structures of heater element terminal posts 72. FIG. 4A is a detailed cross-sectional elevated view of an assembled FIG. 3 contact structure. When locknut 84 is tightened, the lower locknut surface 90 moves into close contact with nut 82 upper surface 92. However, because post threads 94 are formed in a spiral along post 72 (as virtually all conventional threads are formed), locknut lower surface 90 tends to be slightly skewed or tilted from a position exactly perpendicular to post axis 96.

Because of this slightly tilted orientation of locknut 84 (and the resulting unequal distribution of forces within the locknut and nut 82), locknut threads 98 do not precisely engage or mate with corresponding post threads 94 around the entire circumference of post 72. Rather, many of the locknut threads 98 actually float between corresponding post threads 98, decreasing the total surface area of locknut 84 in contact with post 72. Locknut threads 98 in the so-called "crimp" region 95 are in close contact with post threads 94 because of the upward forces resulting from close contact of locknut lower surface 90 with nut 82 upper surface 92. However, the total surface area of locknut threads 98 in this "crimp" region 95 may be (and generally is) insufficient to conduct the large current drawn by heater element 56.

Nut 82 threads 100 typically float between the corresponding post threads 94 and only minimally contact the post threads because nut 82 is suspended by the opposing forces exerted on it by locknut 84 and strip 70.

Conductive strip 70, not being itself threaded, typically does not directly contact post 72. Threads 102 of lower nut 78 contact post threads 94 at some thread surfaces, but because of the downward forces exerted on this lowermost nut by locknut 84 (through upper nut 82 and strip 70), there is rarely full contact between all surfaces of lower nut threads 102 and post threads 94.

FIG. 4B shows schematically how electrical current flows through the FIG. 4A electrical connection. Because strip 70 does not generally directly contact post 72, current cannot flow directly between the strip and the post but instead must flow through nuts 78, 82 and/or 84. Assuming no oxidation has yet occurred and the nuts 78, 82 and 84 are all tight, current can flow from strip 70 into nut 82 along path E1, and then flow from nut 82 into post 72 through nut 82 threads 100 along path C. Current can also flow from strip 70 into nut 82 along path E1, from there flow between contacting surfaces 90, 92 into locknut 84, and finally, flow from the locknut into post 72 along path A (through the locknut threads 98 in crimp region 95) and/or along path B (through locknut threads other than those in the crimp region). Current can also flow along path E2 between strip 70 and lower nut 78 surface 93, and from the lower nut into post 72 through lower nut threads 102 along path D.

Unfortunately, the total cross-sectional contact area between the nuts 78, 82, 84 and post 72 is relatively small. Only a portion of the total surface areas of nut threads 98, 100 and 102 are direct contact with post threads 94 -- substantially decreasing the cross-sectional area through which current may flow into (out of) post 72.

Because of this relatively limited cross-sectional area available for current flow, the electrical connection shown in FIGS. 4A and 4B commonly fails when used in industrial grade food ovens and fryers.

For example, most or all areas of nuts 84, 82 and 78 of the FIG. 4A connection which are not in direct contact with post 72 become badly oxidized. Typically, the entire surface areas of nut 82 threads 100 become badly oxidized (indicating that current cannot flow through those threads and post threads 94 and further preventing such current flow), and nut upper surface 92 likewise becomes fully oxidized. Locknut threads 98 typically also become at least partially oxidized due to inadequate close contact caused by nut tilt. Post threads 94 also generally become oxidized due to absence of good electrical contact with nut threads 98, 100 and 102.

Due to these phenomena, the FIG. 4A connection is inadequate for carrying the current required by heater elements 56. While not all FIG. 4A connections fail, a substantial percentage of them do fail in various, serious ways. For example, in a representative FIG. 3 assembly which I analyzed for failure, the following failure conditions were observed.

In the case of heater element **56*a*, the threads 100 and associated contact surfaces of nut 82*a* became completely oxidized due to floating of these nut threads between post threads 94, preventing current from flowing from post 72a into strip 70 through nut 82*a* along path C shown in FIG. 4B. Nuts 84*a*, 82*a* were still tight, but nut 78*a* has loosened—causing full oxidation of the upper surface 93 of this loosened nut 78*a* and the corresponding lower surface of strip 70. The conditions existing at heater terminal 56*a* led to current transfer to post 76 only along FIG. 4B path A through the threads of locknut 84 in the crimp region 95. Current from phase terminal connection bridge 87 passed into upper nut 82a but failed to transfer to post 72*a* through the threads 100 of the upper nut (path C) due to nut float. The current continued to flow into locknut 84a, but could only transfer into post 72 through threads 94 in the tight crimp area 95 (see FIG. 4A) -- all of the other threads of the locknut (i.e., those along FIG. 4B, path B) being heavily oxidized and/or burned. Due to the loosening of lower nut 78*a* and resulting oxidation of the surfaces of that nut and of the corresponding lower strip surface, no electrical contact existed between the bar and the lower nut along FIG. 4B** path D.

In respect of the conduction to heater **56*b*, both sides of strip 70 were bright ringed (indicating current was still capable of flowing through both of nuts 78*b*, 82*b*). Locknut 78*b* was found to be loosened and its threads 102 were oxidized but apparently still capable of carrying current along FIG. 4B path D. Nut 82*c* upper surface 92 was heavily oxidized and burned, as were many of the threads 98 of locknut 84*c***—so the current was capable of flowing only through FIG. 4B path A and not along path B.

In the case of heater element 56*c*, both sides of strip 70 were found to be bright ringed, but transfer of current between nut 82*c* and locknut 84C was not possible because nut 82*c* upper surface 92 became fully oxidized. Current could flow only along FIG. 4B paths C and D, and not along paths A and B. Post threads 94 were somewhat oxidized but were still capable of carrying current.

Heater elements 56*d* and 56*e* has also failed or nearly failed, exhibiting conditions which were intermediate in severity to those of heater elements 56*b* and 56*c*.

In summary, it was found that the electrical connection shown in FIGS. 4A and 4B generally provided poor electrical conduction at the point of contact of between threads. Because locknut 84 is a crimp against upper nut 82, the locknut presses against the upper nut and applies a downward force on lower nut 78. The floating (disengaged) upper nut 82 threads 100 end up with poor, if any, electrical contact with post threads 94. If locknut 84 is crimped only to upper nut 82 (as appears to be the case in some instances), lowermost nut 78 may be left floating, resulting in burning of the upper and lower surfaces of strip 70.

These failures which virtually always occur in the FIG. 2 heater connection matrix 50 after normal use are serious enough to require replacement of the entire heater unit. Strips 70 in the vicinity of heater posts 72 become burned, and in some cases, arc sputtered. Strips 70 also become heat oxidized and warped from excessive heating of nuts 84, 82 and 78 due to bad electrical connections between the nuts and the heater terminal posts 72. Strips 70 also became blued or browned (black scale conditions) from excessive heating due to arcing between post 72 and strip 70 and/or nuts 78, 82 and 84. All terminations evidence heavy oxidation with complete oxidation of threading except in locknut 84 crimp areas 95. As burn cones develop, the transfer of current moves from nuts 78 and 82 to only the crimped area of locknut threads 98. Locknuts 84 then melt in the region of crimp area 95 because an insufficient cross-sectional contact area is called upon to carry an excessive amount of current. Oxidized terminals begin to flash over to housing 65 due to the relatively high voltages on the terminals and insufficient clearances between the terminals and the housing (phase-to-neutral conductive clearances in the prior art FIG. 2 arrangement were found in some cases to be less than 0.25 inches)—causing further melting of terminals and further excessive heating and also dangerous arcing ground faults where 480 VAC wiring is arc connected to the main oven bodies..

Even the phase terminals 60 in the prior art FIG. 2 matrix 50 were found to break down. For example, nickel plated screws 120 typically burn out completely due to oxidization of the screw threads, causing nickel plated wires 122 to arc melt away from the terminal. As will be understood, loose wire 122 within housing 65 can present a life-threatening hazard in cases where grounding of the furnace housing is insufficient or has failed (and at the very least, may cause circuit breakers or other protective devices to open the heater circuit and shut down the entire oven).

The prior art FIG. 2 termination failures lead to excessive levels of load imbalance on oven feeder lines connected to phase terminals; 60 (over 20% or more) due to numerous cases of defective terminal connections. As the in service life of the FIG. 2 matrix is prolonged, more and more of heater elements 56 become inoperative until the entire matrix fails and must be replaced.

This prior art matrix 50 fails many other reliability and safety criteria related to electrical insulation and connection design. For example, the electrical insulation used is extremely deficient, especially considering the temperature of operation of industrial ovens and the effect high temperatures have on air ionization and reduction of the insulative properties of air. Frequent flashing over between the phase conductors and ground conductors is in evidence and life safety hazards are presented unless outer housings are well tied to ground conductors -- and at the very least, flashing over wastes energy, causes excessive currents to be drawn, presents fire hazards. These events force premature replacement or modification of the equipment, and frequently force electrical system disconnection due to protective device sensing of the ground fault occurrence. Connection overheating due to use of screw thread connections may give rise to equipment fire or main conductor meltdown, and eventually causes most of heating elements 56 to become inoperable or inefficient as has been described.

SUMMARY OF THE INVENTION

The present invention provides an improved electrical connection to replace the heater element matrix of the type shown in FIG. 1 which reliably carries high currents and is capable of withstanding the relatively high voltage levels applied to it in industrial oven and fryer applications. The invention uses compression-type electrical connections instead of the screw-type connections used in the prior art to insure that all electrical connections have reliable, relatively large current-carrying cross-sectional contact areas. Because of the increased reliability and increased current-carrying capacity of the connections provided by the present invention, the connectors do not become overheated or loosen even with extended service in high-power industrial ovens and fryers.

BRIEF DESCRIPTION OF THE DRAWINGS

These and other features and advantages of the present invention will be better and more completely understood by referring to the following detailed description of present preferred exemplary embodiments in connection with the appended sheets of drawings, of which:

FIG. 2A is a perspective view of an industrial oven of which the FIG. 1 element connection matrix is a part;

FIG. 2B is a perspective view of the prior art heater elements matrix shown in FIG. 2;

FIGS. 4A and 4B are detailed diagrams of one of the FIG. 2 electrical connections;

FIGS. 5–9B are cross-sectional views of possible alternate electrical connections for use in a heater element matrix;

FIGS. 10 and 10A are perspective views of a presently preferred exemplary embodiment of a electrical compression connection in accordance with the present invention used for connecting conductor elements made of similar materials;

DETAILED DESCRIPTION OF THE PRESENTLY PREFERRED EXEMPLARY EMBODIMENTS.

Figure 1:
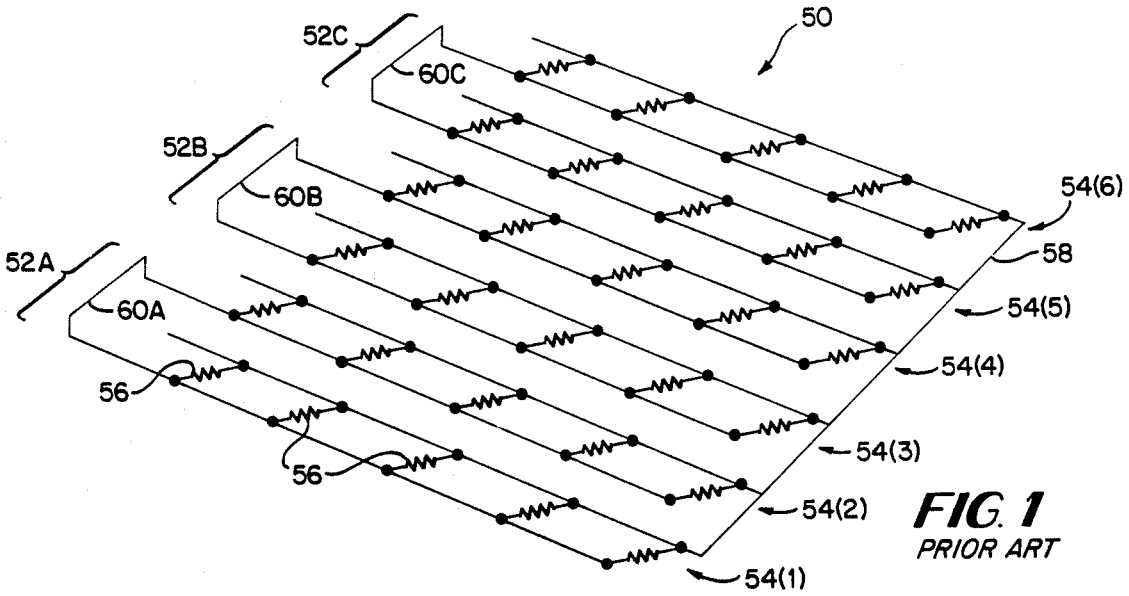
FIG. 1 PRIOR ART
FIG. 1 is an electrical schematic diagram of a prior art heater element connection matrix.
Figure 2:
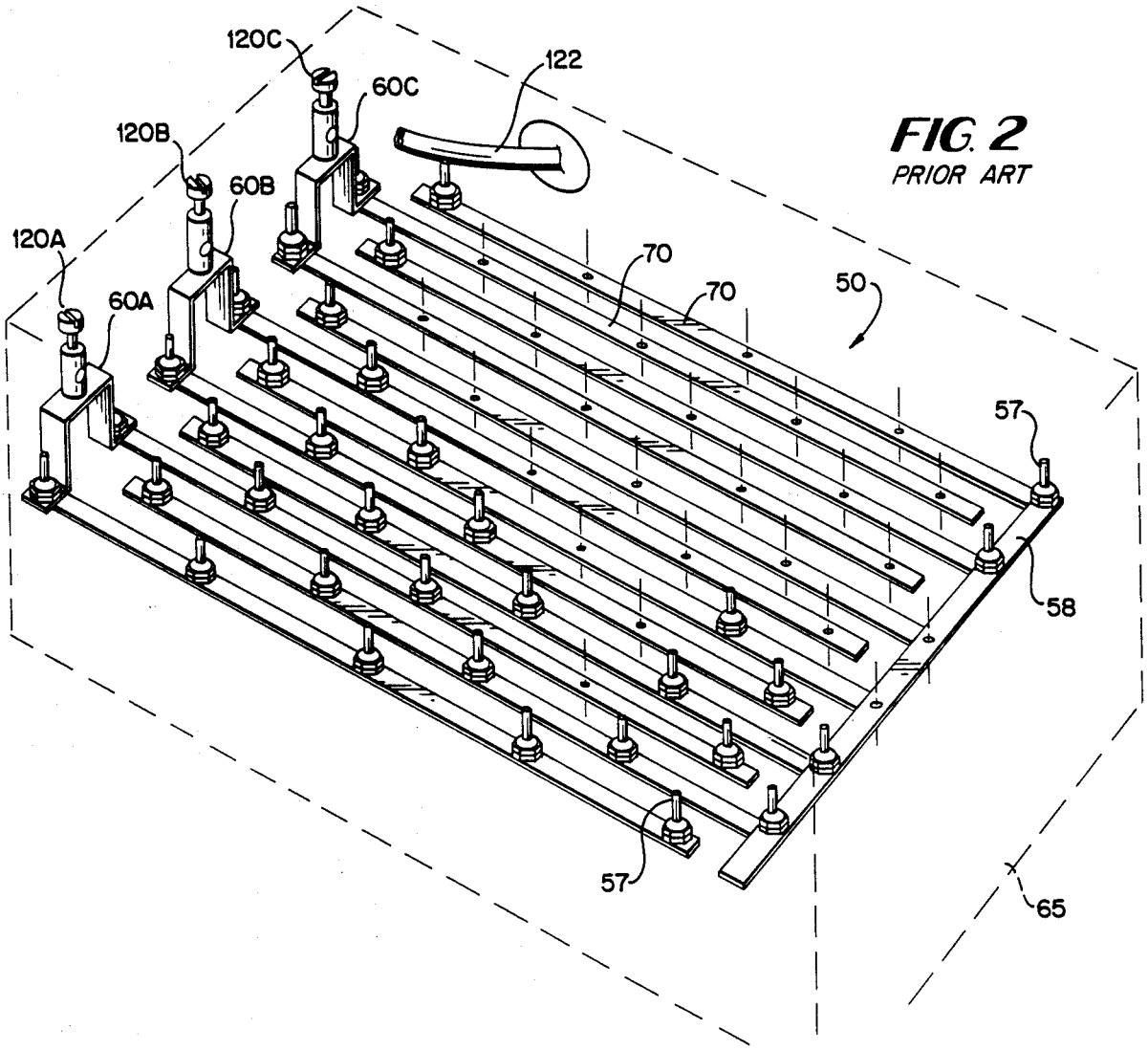
FIG. 2 PRIOR ART
FIG. 2 is a partial perspective view of the prior art matrix shown in FIG. 1.
Figure 3:
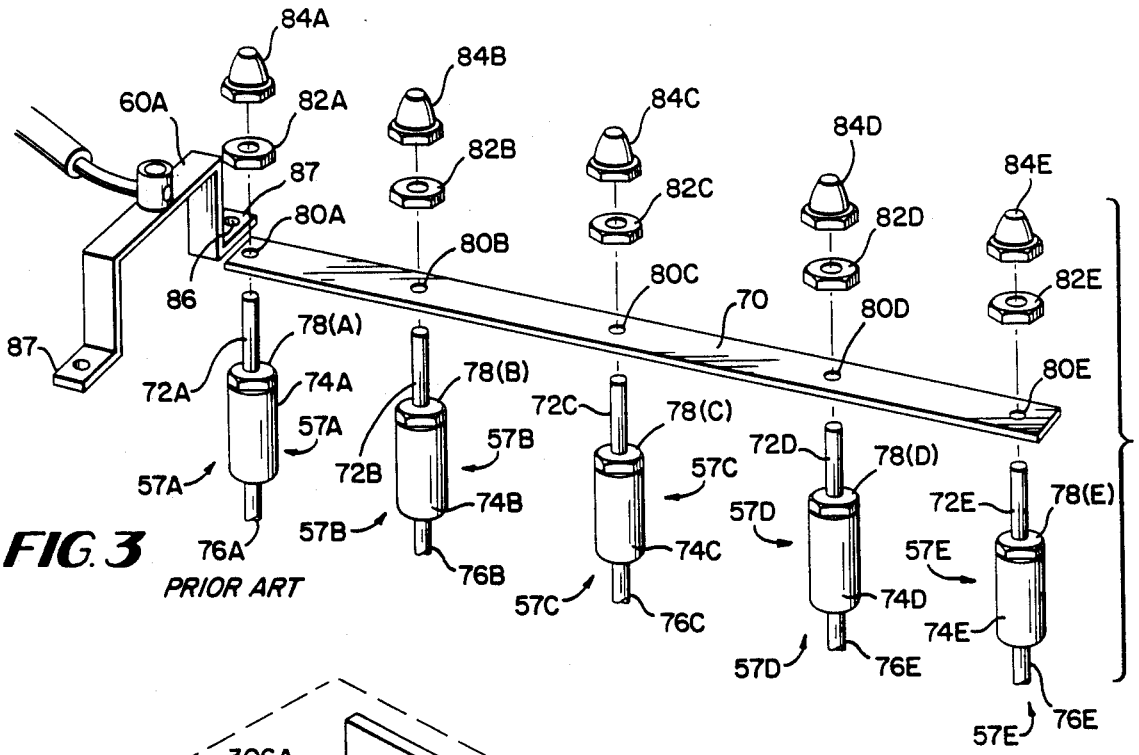
FIG. 3 PRIOR ART
FIG. 3 is an exploded view of a single strip assembly of the FIG. 2 matrix.

Alternate screw-type connection structures which might be considered for use in the FIG. 2 connection matrix are shown in FIGS. 5 and6. After investigation, the FIG. 5 and 6 connections have been determined to suffer from many or all of the same disadvantages as the connection shown in FIG. 4A.

FIGS. 5 and 5A show a threaded connection post 72 connected to a connection strip 70 by an upper nut 82 and a lower nut 78. As in the FIG. 4 configuration, the cross-sectional contact area between the threads of nuts 78, 82 and the post threads provides only a limited conduction path with partial contact here and there -- giving rise to spasmodic arc burning. Cyclic heating and cooling of the heating device leads to relaxation and loosening of nut 82 and/or nut 78 with subsequent burning of threads and contact rings. The conductivity of the current transfer paths (shown in phantom in FIGS. 5 and 5A) depend principally on compression between nuts 78, 82 and strip 70, and the mechanical strength of post 72 and the threads of nuts 78, 82 are generally inadequate for providing this high degree of compression.

FIG. 6 is yet another configuration using a lower, flat nut 78 and an upper locknut 84. This FIG. 6 assembly is superior to the one shown in FIG. 4 because it avoids an intermediate upper floating nut disposed between the locknut and conductor strip 70. However, locknut 84 provides an even more limited cross-sectional current-carrying contact area, since only locknut threads in crimp area 95 are in close contact with threads of post 72. The tightness of nut 78*c* is still exposed to heating cycle relaxation, permitting the nut 78*c* to "walk" away from the fixed location of locknut 84*c* and conductive strip 70 (so that the FIG. 6 assembly is no better in this respect than is the FIG. 5 assembly).

FIG. 7 shows a connection bus structure 174, 176 which relies on compression washers 164, 168 to create annular conductive compression contact rings between adjacent contacting surfaces. A half-inch bolt 152 fabricated from high tensile steel is used for insuring high mechanical compression. A first bus conductor 154 and a second bus conductor 156 each define circular holes (158, 160) respectively, through which bolt threaded portion 162 is passed. A high-strength compression washer 164 (having dimensions of one and a quarter inches by one-eighth inches, for example) is disposed between a steel bolt 166 and lower bus bar 156; and another compression washer 168 is disposed between bolt head portion 170 and upper bus bar 154. Bolt 152, bolt 166, bus bars 154, 156 and compressor washers 164, 168 are preferably all made of the same type of metal to prevent undesired electrolysis or other chemical reaction from occurring.

When the threads of nut 166 are engaged with the threads of bolt 152 and the nut is tightened onto the bolt, an annular compression contact area 172 (shown in phantom in FIG. 7) is created between lower bus bar upper contacting surface 174 and upper bus bar lower contacting surface 176, this annular conductive ring producing a 500 amp conductivity path due to its extremely high and even contact pressure. The FIG. 7 connection may not be completely appropriate for connecting heater elements 56 to conductor strips 70, but is ideal for connecting two conductive buses together. The FIG. 7 connection structure 150 is reliable, has more than adequate current-carrying capacity, and will not tend to mechanically loosen when exposed to repeated oven temperature cycling.

FIG. 8 illustrates the principle of using an exothermic weld to join bus conductors made of dissimilar metals. Due to electrolytic reaction between dissimilar metals, it is not desirable to connect conductive buses made of different metals together using, for example, the arrangement shown in FIG. 7. Rather, as is shown in FIG. 8, an aluminum conductive bus 190 should be connected to a copper conductive bus 192 with an exothermic weld 194 using compression contact 196 between the dissimilar conductive buses to form a molecularly bonded joint. The FIG. 8 arrangement may not be convenient for connecting heater elements 56 to conductive strips 70, but is shown to illustrate the necessity of weld bonding of dissimilar metals.

FIGS. 9A and 9B show the principle of a crimp connection 200 which can be used to connect unthreaded heater element terminal post 202 to a cylindrical conductor. Crimp connection 200 includes a cylindrical connector 204 having hollow cylindrical portions 206, 208. Cylindrical portions 206, 208 can be crimped around cylindrical conductors having slightly smaller outside diameters than the inside diameters defining the cylindrical portions hollows 207, 209, respectively. One disadvantage of crimp connection 200 is that oxide can form in the space 210 between heater element post 202 and crimp connector lower portion inner surface 212, this oxide decreasing the current-carrying cross-sectional area of contact between crimp connector 204 and the heater element post. Crimp connections 200 should probably be used only in industrial oven applications when it is practical to silver solder the interface between post 202 and crimp connector inner surface 212, the silver solder insuring that an oxidation-free electrical connection is maintained.

FIG. 10 shows a presently preferred exemplary compression connection 250 useful for connecting heater elements 56 to conductive strips 70. Connection 250 includes a flat discoid heater element lug 252 and a flat discoid connection strip lug 254. Lug 252 includes a disk portion 256 having a central hole 258 defined therethrough, this disk portion being integrally formed with and terminating unthreaded heater post 72. Conductive strip 70 terminates in an integrally formed disk portion 262 with a circular hole 264 defined therethrough. Disk portion 256 and disk portion 262 are made of the same metal so that when lug 252 upper surface 266 is disposed in contact with lug 254 lower surface 268, no electrolytic or other chemical reaction occurs over time to compromise the electrical connection between these two surfaces.

In one embodiment, a cold formed rivet 270 establishes a compression connection between lugs 252, 254. One or more compression washers 272 are used to insure that the compression forces exerted by rivet head 274 onto lug disk portions 256, 262 are distributed evenly to establish an annular compression contact area 276 (see area shown in phantom in FIG. 10A). A further compression washer 272 may be disposed between lug disk portion 262 and rivet head 274 if desired to even further insure uniform force distribution. If desired, rivet 270 can be replaced with a stainless steel high tensile bolt and retaining nut assembly.

Figure 11:
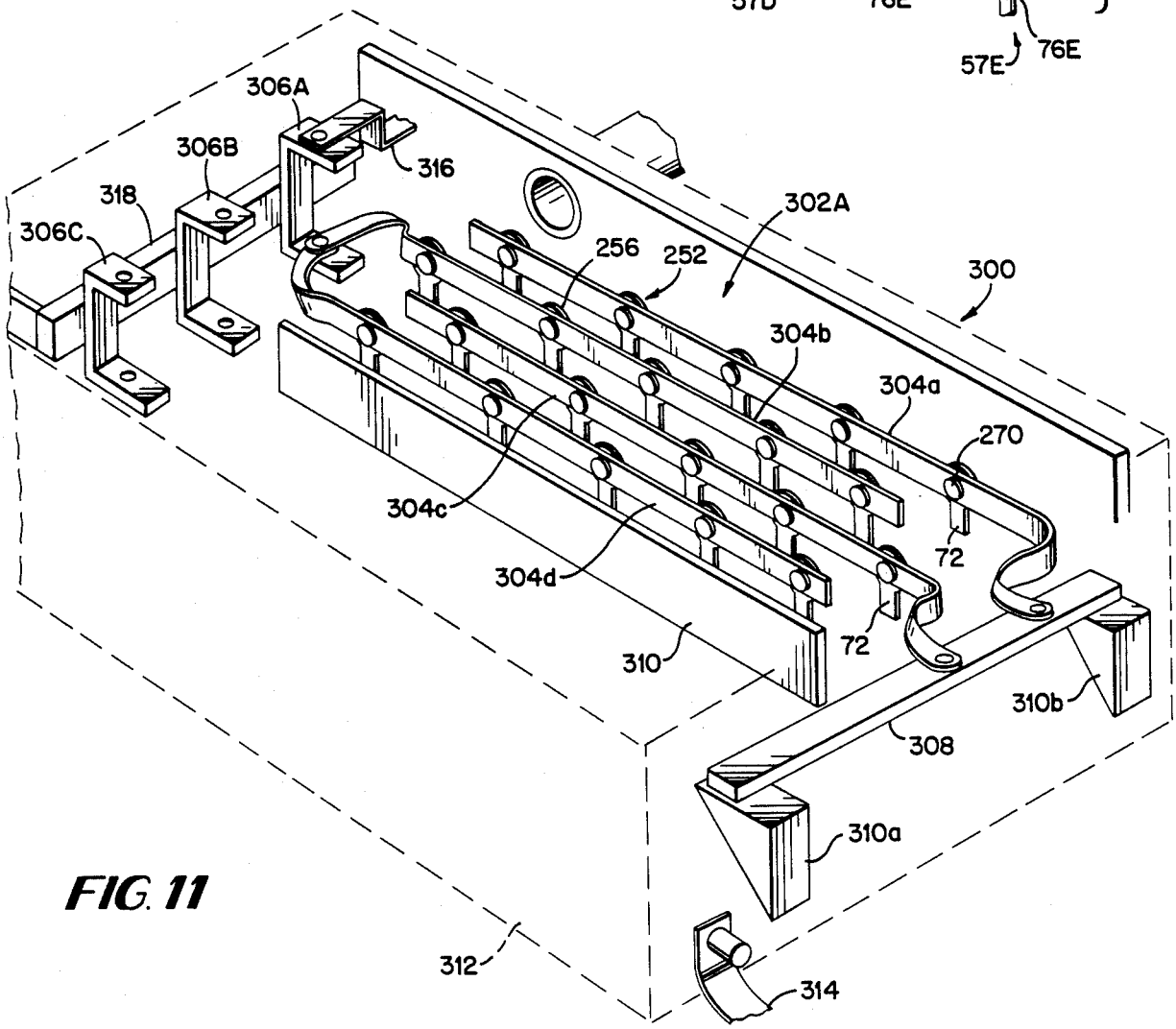
FIG. 11 shows a bus strip heater element connection matrix utilizing the electrical connection shown in FIG. 10.

FIG. 11 is a partial perspective view of an exemplary heating element bus strip connection matrix 300 provided by the present invention. FIG. 11 shows a connection sub-matrix 302*a* connecting ten heating elements 56 with one of three input phase terminals 306A, the other two sub-matrices being identical to the sub-matrix shown (and being connected to phase terminals 306*b*, 306*c*, respectively).

Sub-matrix 302*a* includes four parallel flat conductive strips 304*a*–304*d*, with strips being alternately connected to phase terminal 306*a* and neutral bus 308 (in the embodiment shown, strips 304*a* and 304*c* are connected to the neutral bus and strips 304*b* and 304*d* are connected to the phase terminal). A ceramic phase barrier insulating strip 310 is installed between sub-matrix 302*a* and adjacent sub-matrices to insure that no arcing or direct electrical connection between different phase terminals can occur.

The compression connection shown in FIG. 10 is used throughout sub-matrix 302*a* for connection of nickel-copper strips 304 to nickel-copper heater element posts 72. In the preferred embodiment, heater element posts 72 are flat rather than cylindrical and terminate in flat disks portions 256 with center holes 258 drilled therethrough. Rivets 270 and compression washers 272 are used to establish a compression connection between strips 304 and heater element lugs 252 (see FIG. 10A, a detailed cross-sectional view of one of the electrical connections of the FIG. 11 embodiment). Connections 250 are also used to connect strips 304 to neutral bus bar 308 and to phase terminal 306*a*.

Neutral bus bar 308 is preferably supported on ungrounded, insulated ceramic support members 310 in order to withstand the full peak voltage which may be present on matrix 302*a* (i.e., 2.25×480 VAC+1000 VAC as a safety factor). Neutral bus bar 308 may be mounted sideways on ceramic posts 310 if desired, or alternatively, can be oriented rotated 90° from the orientation shown if more convenient. Housing 312 is conductive (e.g., made of stainless steel), and is preferably directly connected to ground via a grounding strap 314. Phase terminals 306 are fed by flat conductive strips (i.e., "conductive tape") 316 to wire terminations outside of housing 312.

The compression connections 250 used for each of the electrical connections in the FIG. 11 sub-matrix 302*a* provide more than sufficient cross-sectional contact area to carry the current drawn by heater elements 56. In addition, the great force exerted by each of strip 304 and heater terminal disk 256 upon the other in the region of compression contact ring 276 not only ensures mechanical strength and prevents relative movement of the two contacting parts, but also guarantees that no oxidation or arc burning can occur between these two parts (since the contacting surfaces joined in this compression ring provides a superb current-carrying path). Contact melting, arcing and oxidizing is eliminated, resulting in a far more reliable overall structure.

Figure 12:
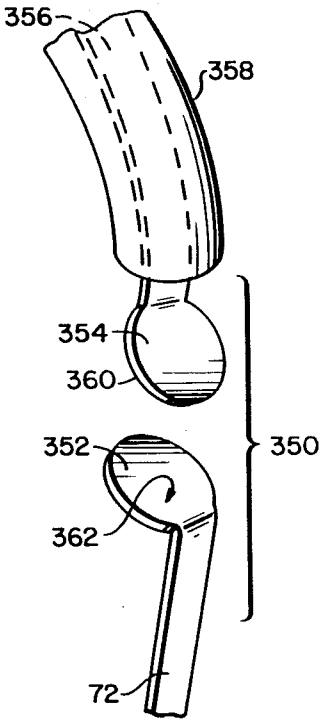
FIG. 12 is a perspective view of a further presently preferred exemplary impression connection in accordance with the present invention for use in connecting conductor elements made of dissimilar materials.

The FIG. 10 connection structure 250 is preferably used to join parts made of similar metals, since electrolysis in the contact area between heater terminal post 252 and strip 70 made of dissimilar metals could, after awhile, reduce the conductivity of the connection. FIG. 12 is a schematic diagram of another exemplary connection structure 350 useful for joining dissimilar metals. Structure 350 includes a press-formed connection pad 352 formed integrally with cylindrical heater element poast 72, and another press-formed connection pad 354 formed integrally with a conductive strip 356. A conductive sleeve 358 (e.g., glass fiber tubing) encases conductive strip 356 to prevent the strip from contacting nearby conductors.

It is relatively easy and inexpensive to form connection pads 354, 352 on the ends of strip 356 and conductor posts 72, respectively. To establish a reliable connection having high current-carrying capacity between strip 356 and post 72, pads 354, 352 are clamped tightly together to compress the pad surfaces 360, 362 and then spot welded or brazed together at opposing flat conductive surfaces 360, 362, respectively. Because each of pads 354, 352 has a relatively large surface area, large amounts of currents can flow from one pad to the other. The use of an exothermic weld of the type shown in FIG. 8 for welding pads 352, 354 together permits the use of different types of metals (e.g., nickel-copper for conductive strips 356 and stainless steel for heater element posts 72).

Figure 13:
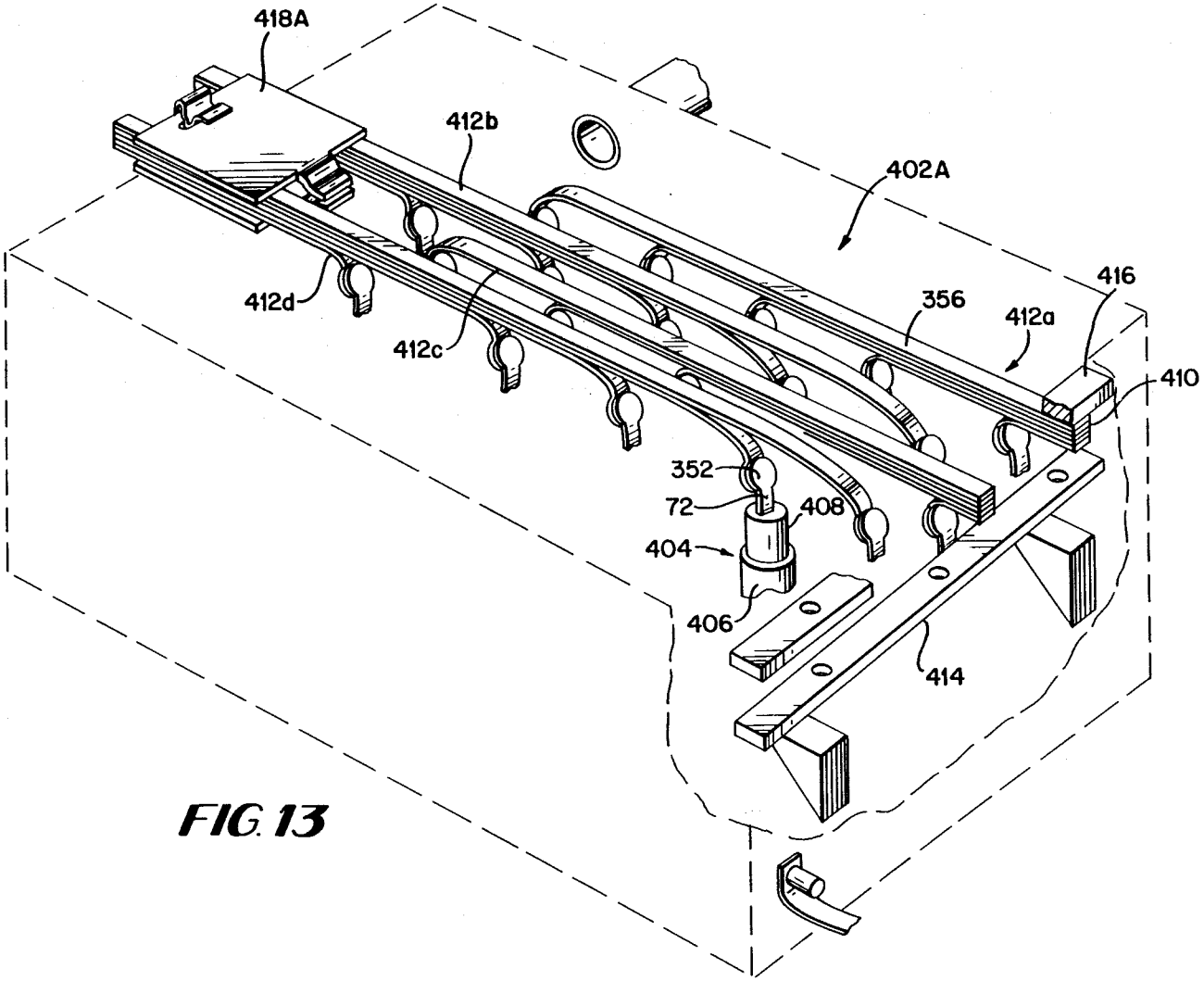
FIG. 13 is a perspective view of an alternate, presently preferred exemplary embodiment of a unit strip electrical heater element connection matrix using the FIG. 12 electrical connection.

FIG. 13 is a partial perspective view of a unit strip heater element connection sub-matrix 402*a* using the electrical connection structure 350 shown in FIG. 12. FIG. 13 shows the connection sub-matrix 402*a* for one of three incoming power phase terminals 418*a*, it being understood that two addition, identical sub-matrices are used for the other two phase terminals. The unit strip connection arrangement shown in FIG. 13 provides a reduced number of connection joints and facilitates replacement of individual faulty heater elements.

Each heater element terminal 72 includes a head portion 404 formed as a riser above a tube 406. Tube 406 encases the element terminal 72 to minimize the possibility that connection 350 might shift in position. Head 404 includes a three-quarter inch long ceramic riser (spacer) 408 formed of vitreous enamel which has been coated to prevent water absorption. Heater element connection post 72 protrudes from ceramic riser 408, and is integrally formed with press-formed connection pad 352.

Individual conductive strips 356 (termed unit strip connectors) are provided for each heater element terminal 72 in the preferred embodiment, each strip terminating at one end with a press-formed connection pad 354 and terminating at its other end in a flat, cleanly-cut edge surface 410. Individual glass fiber tubes (preferably impregnated with silicon) are installed over each of strips 356.

One "stack" 412*a* of conductive strips 356 connects five heater element connection pads 352 to a neutral bus bar 414 -- each of the strips in this stack being precisely cut in length so that the terminating edge surfaces 410 of all five strips lie in the same plane when the stack of strips is compression clamped to neutral bar 414 using clamp assembly 416. Similarly, strip stack 412*d* connects five heater element connection pads 352 to phase terminal compression clamp assembly 418*a* which also acts as a compression clamp for stack 412*b* of phase-terminal connected conductive strips 356.

Figure 14:
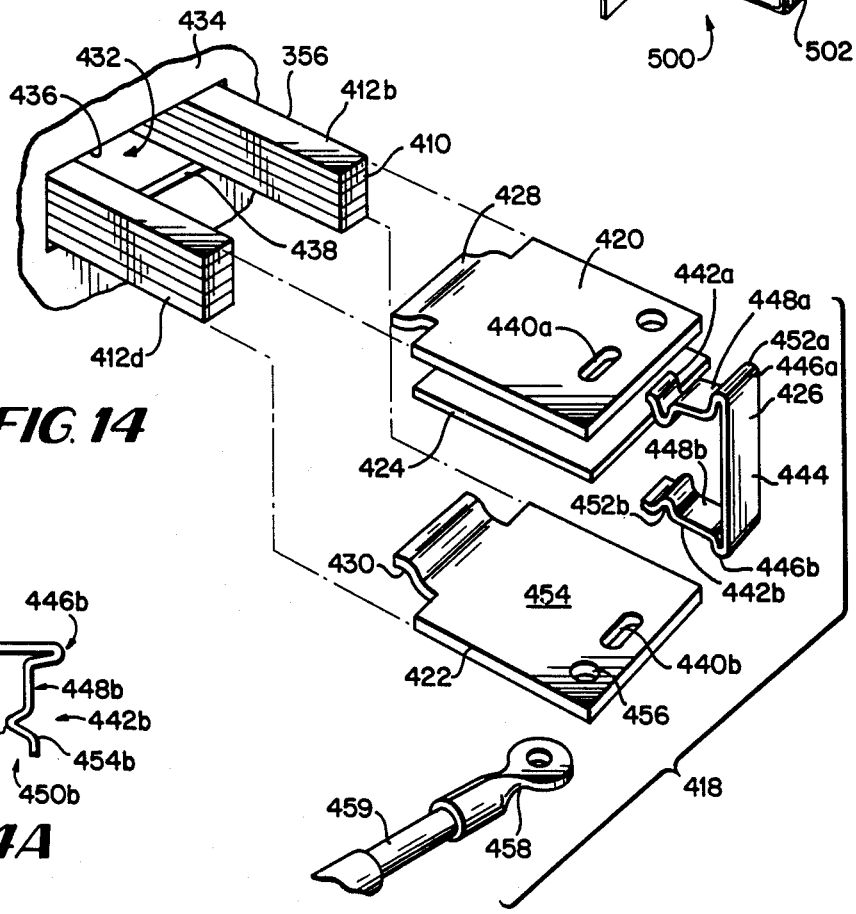

FIG. 14 is a detailed perspective view of phase terminal strip stack compression clamp assembly 418 shown in FIG. 13. Clamp assembly 418 includes an upper plate 420, a lower plate 422, a mica insulative separator 424 and a compression spring 426. Upper and lower plates 420, 422 are rectangular in shape in the preferred embodiment and define lock lever shoulders 428, 430, respectively. Two strip stacks 412 protrude through a slot 432 in an insulative plate (shroud) 434, a gap being defined between the two stacks. Shoulders 428, 430 are dimensioned to snap fit into slot 432 between two conductive strip stacks and rest in contact with slot edges 436, 438.

In the embodiment shown, conductive strips 356 are made of nickel-copper, and plates 420, 422 are made from the same material. Plates 420, 422 each define elliptical slots 440. Slots 440 are of the size and shape which permit them to accept and retain curved distal end portions 452 of beryllium copper compression spring 426.

Figure 14A:
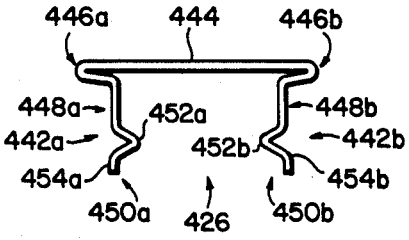

Referring more particularly to FIG. 14A, spring 426 includes a relatively flat, elongated center portion 444 connected by hairpin curved portions 446 to distal end portions 442. Short flat portions 448 connect hairpin portions 446 to distal end portions 450. Distal end portions 450 include inwardly-curved hairpin portions 452 connected to flat portion 448, the other end of the hairpin portions terminating in an outwardly curved distal portion 454. Spring 426 is symmetrical in the preferred embodiment with flat portions 448 being substantially parallel to one another, so that either curved portion 452 is capable of fitting into the slot 440 defined by either of plates 420, 422.

To assembly compression clamping structure 414, stacks 412 are disposed to protrude out of slot 432, and then mica separator 424 is placed on top of the stacks. Upper compression plate shoulder 428 is slid into slot 432 between stacks 412, and the upper plate is rotated downward toward the stacks until the plate is parallel to and in contact with separator 424. Similarly, lower plate shoulder 430 is slid into slot 432, and the lower plate is rotated upward until it is in direct contact with the flat portion of the lowest conductive strip 356 in each of stacks 412. Compression spring inwardly curved portions 452*a*, 452*b* are then engaged with upper and lower plate slots 440*a*, 440*b*, respectively.

Compression spring 426 applies great pressure to plates 420, 422 -- compressing stacks 412 and forming a compression connection between contacting strips 356 in the stacks and between the stacks and lower plate planar upper conductive surface 454. A circular hole 456 drilled through an edge of lower plate 422 is used to connect to a flat lug 458 of an incoming phase power line (e.g., using the rivet compression connection shown in FIG. 10 with a silver solder seal between lug 458 and phase conductor 459).

Figure 15:
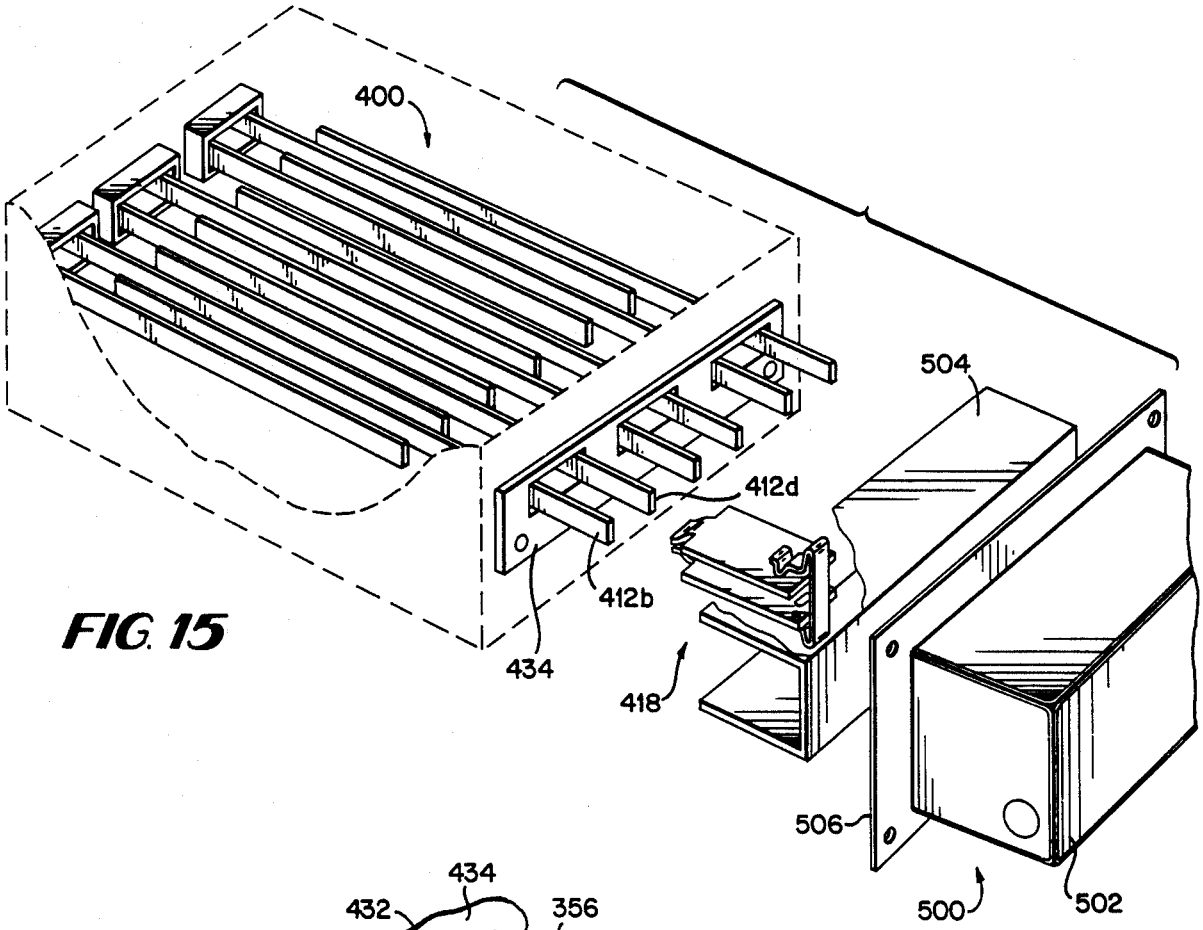
FIGS. 14, 15 are exploded perspective views of the unit strip terminal clamping structure shown in FIG. 13.

FIG. 15 is an exploded perspective view of the FIG. 12 matrix 400 and a terminal assembly 500. Phase terminal assembly 500 includes three terminal compression assemblies 418 housed in a common retaining box cover 502. The neutral strip connections may also be terminated in the same manner. Silicon fiber sheetign 504 is used to prevent cover 502 from contacting assemblies 418. A seal flange 506 disposed on cover 502 prevents moisture from entering the cover. Cover 502 and insulator 504 in assembly press on connector springs 426 acting as a retaining clamp on the springs.

The present invention provides improved electrical heater connection matrices which utilize electrical compression connections. These compression connections provide mechanically strong and reliable electrical contact structures which force substantially large planar areas of contacting current-carrying conductors into direct contact with one another -- providing large current-carrying capabilities and reducing or eliminating conductor burning, overheating and arcing. Incorporating such compression connections into an electrical oven heater element connection matrix guarantees reliable heater element service over long time periods despite temperature cycling and large continuous or intermittent current draw.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An industrial heating device including:

a heating chamber;

a conductive strip connected to a power input terminal;

electrical heating element means operatively connected to said chamber for heating said chamber, said electrical heating element means having an electrical terminal directly contacting said conductive strip; and connection forming means mechanically coupled to said strip and said heating element terminal for forming an electrical compression connection between said conductive strip and said heating element electrical terminal and for enhancing the flow of electrical current between said conductive strip and said contacting electrical terminal, said connection forming means including:

a first annular compression washer means disposed in contact with said electrical terminal, a second annular compression washer means disposed in contact with said strip, said strip and said electrical terminal contacting one another and being disposed between said first and second annular washers means, and fastener means for biasing said first and second washers means together, said first and second washer means for creating an annular electrically conductive compression contact area between said strip and said contacting electrical terminal, substantially all of said electrical current flowing between said conductive strip and said contacting electrical terminal through said annular electrically conductive compression contact area.

2. A heating device as in claim 1 wherein:

said heating element terminal includes a flat conductive disk defining a hole therethrough;

said conductive strip defines a hole therethrough; and said fastener means includes high tensile steel bolt means disposed through said disk hole and said strip hole for biasing said first and second annular washers means together.

3. A heating device as in claim 2 wherein said disk and strip comprise similar metals.

4. A heating device as in claim 2 wherein said fastener means includes a rivet having: (a) an elongated cylindrical center portion disposed within said disk hole and strip hole, (b) a first enlarged portion means disposed on one end of said cylindrical center portion in contact with said first washer means for applying a first force to said conductive strip through said first washer means, and (c) a second enlarged portion means disposed on another end of said cylindrical center portion in contact with said second washer means for applying a second force opposing said first force to said disk through said second washer means.

5. A device as in claim 1 wherein:

said conductive strip has a first surface and a second surface opposing said first surface;

said electrical terminal has a first surface and a second surface opposing said first surface;

said first annular washer means is disposed in contact with electrical terminal first surface;

said second annular washer means is disposed in contact with said conductive strip first surface;

said conductive strip second surface is disposed directly in contact with said terminal second surface; and said annular compression contact area formed by said fastener means is distributed evenly in a ring between said first and second annular washers at the contacting conductive strip second surface and terminal second surface.

6. An industrial heating device including:

a heating chamber;

a conductive strip connected to a power input terminal;

electrical heating element means operatively connected to said chamber for heating said chamber, said electrical heating element means terminating in an electrical terminal, said electrical terminal directly contacting said conductive strip; and connection forming means mechanically coupled to said strip and said heating element electrical terminal for providing an electrical current pathway between said conductive strip and said heating element electrical terminal, wherein:

said heating element electrical terminal including an integral press-formed contact portion defining a substantially planar first contact surface;

said strip terminating in a further press-formed contact portion defining a substantially planar further contact surface in direct contact under compression with said first contact surface; and said connection forming means including an exothermic weld maintaining said compression contact between said first and further contact surfaces such that substantially all electrical current flowing between said conductive strip and said heating element electrical terminal flows directly between said first contact surface and said further contact surface.

7. A heating device as in claim 6 wherein said heating element contact portion and said strip contact portion comprise dissimilar metals.

8. In an industrial oven of a type including a heating chamber and a matrix of heating elements operatively connected thereto for heating said chamber, said matrix including:

a power input terminal connected to at least one phase of a multi-phase external power source;

a conductive strip connected to said power input terminal, said strip defining plural holes therethrough;

plural tubular electrical heating elements connected to said conductive strip, each heating element at least partially disposed within said chamber, each heating element including a cylindrical post terminating in a substantially planar electrical terminal pad integrally formed with said cylindrical post, said terminal pad directly contacting said conductive strip, said pad including means defining a hole therethrough aligned in registry with an associated one of said conductive strip plural holes; and plural electrical connection forming means mechanically coupled to said electrical terminal pads and said conductive strip for forming electrical current pathways between said conductive strip and said corresponding plural electrical terminal pads, each said plural electrical connection forming means including:

a first non-planar compression washer disposed in contact with said heating element electrical terminal pad, said first washer having a hole therethrough, said first washer hole aligned with said electrical terminal pad hole, a second non-planar compression washer disposed on said conductive strip, said second washer having a hole therethrough, said second washer hole aligned with one of said holes in said conductive strip, and a rivet having first and second heads connected together by a center body portion, said body portion disposed through said aligned first washer hole, said electrical terminal pad hole, said conductive strip hole and said second washer hole, said rivet exerting compression forces forming an annular electrical contact compression region at the contact between said heating element electrical terminal pad and said conductive strip, said first and second non-planar washers insuring that the compression forces exerted by said rivet heads are distributed evenly to establish said annular electrical contact region, substantially all electrical current flowing between said terminal pad and said conductive strip flowing through said annular contact region directly between said terminal pad and said conductive strip, substantially none of said electrical current flowing between said terminal pad and said conductive strip flowing through said rivet center body portion.

9. An industrial oven including:

means defining a heating chamber for cooking food; and a heating element matrix for heating said chamber, said matrix including:

an electrically conductive power input terminal, plural electrical heating elements operatively connected to said chamber, each heating element having at least one electrical terminal, plural substantially planar electrically conductive strip conductor means connecting said heater element electrical terminals to said power input terminal, each strip conductor means connecting a single associated heater element terminal to said power input terminal, said plural strip conductor means being arranged in a stack and directly contacting adjacent ones of said plural strip conductor means in said stack, and clamping means for forming electrically conductive compression regions between contacting strip conductor means adjacent in said stack and for forming a further compression region between said power input terminal and at least one of said strip conductor means, substantially all electrical current flowing between said power input terminal and said plural heating elements flowing through said compression regions.

10. An oven as in claim 9 wherein said clamping means includes:

first and second plates opposing one another, said stack disposed between said plates; and biasing means for biasing said plates toward one another, said biasing means including a compression spring having a first end disposed on said first plate and a second end disposed on said second plate.

11. An oven as in claim 9 wherein:

said clamping means includes first and second plates opposing one another, said stack disposed between said plates, said first and second plates each define a slot therethrough; and said biasing means comprises a compression spring including a flat elongated center portion having first and second ends, a first hairpin portion connected to said center portion first end, a second hairpin portion connected to said center portion second end, and first and second distal end portions, said first distal end portion being connected to said center portion first end by said first hairpin portion, said second distal end portion being connected to said center portion by said second hairpin portion, said first distal end portion being engaged with said first plate slot, said second distal end portion being engaged with said second plate slot.

12. An oven as in claim 9 wherein:

said oven further includes:

a housing having first and second wall portions defining a slot therebetween, and further plural strip conductor means being arranged in a further stack, said first-mentioned and further stacks being disposed in said slot; and said clamping means also forms compression connections between adjacent strip conductor means in said further stack and forms a compression connection between said power input terminal and at least one of said strip conductor means of said further stack.

13. An oven as in claim 12 wherein said clamping means engages with said housing first and second wall portions.

14. An oven as in claim 12 wherein said first and second plates each define slots therethrough, and said biasing means engages with said first plate slot and second plate slot.

15. An industrial oven including:

means defining a heating chamber;

a housing having first and second wall portions defining a slot therebetween; and a heating element matrix for heating said chamber, said matrix including:

a power input terminal;

plural electrical heating elements operatively connected to said chamber, each heating element having at least one electrical terminal, plural strip conductor means connecting said heater element electrical terminals to said power input terminal, each strip conductor means connecting a single associated heater element terminal to said power input terminal, said plural strip conductor means being arranged in a stack, further plural strip conductor means being arranged in a further stack, said first-mentioned and further stacks being disposed in said slot; and clamping means for forming compression connections between strip conductor means adjacent in said stack and for forming a compression connection between said power input terminal and at least one of said strip conductor means, said clamping means also forming compression connections between adjacent strip conductor means in said further stack and forming a compression connection between said power input terminal and at least one of said strip conductor means of said further stack, said clamping means including:

a first conductive plate defining a shoulder portion disposed in said slot between said first-mentioned and further stacks and engaged with said housing first wall portion;

a second conductive plate defining a shoulder portion disposed in said slot between said first-mentioned and further stacks and engaged with said housing second wall portion; and biasing means connected to said first and second plates for forming electrical compression connections between said first plate and said first-mentioned and further stacks.

16. An oven as in claim 14 further including a mica separator disposed between said second plate and said first and second stacks.

17. In an industrial oven of a type including a heating chamber and a matrix of heating elements operatively connected thereto for heating said chamber, said matrix including:

a power input terminal connected to at least one phase of a multi-phase external power source;

a conductive strip connected to said power input terminal, said strip defining a hole therethrough;

a tubular electrical heating element connected to said conductive strip, said heating element at least partially disposed within said chamber, said heating element including a cylindrical post terminating in a substantially planar electrical terminal pad integrally formed with said cylindrical post, said terminal pad directly contacting said conductive strip, said pad including means defining a hole therethrough aligned in registry with said conductive strip hole; and electrical connection forming/maintaining means mechanically coupled to said electrical terminal pad and said conductive strip for providing a reliable path for enhancing the flow of electrical current directly between said conductive strip and said electrical terminal pad and for preventing arcing and oxidation from occurring along said path between said conductive strip and said terminal pad, said electrical connection forming/maintaining means including:

a first non-planar compression washer disposed in contact with said heating element electrical terminal pad, said first washer having a hole therethrough, said first washer hole aligned with said electrical terminal pad hole, a second non-planar compression washer disposed on said conductive strip, said second washer having hole therethrough, said second washer hole aligned with said hole in said conductive strip, and a fastener having first and second heads connected together by a center body portion, said body portion disposed through said aligned first washer hole, said electrical terminal pad hole, said conductive strip hole and said second washer hole, said fastener in combination with said first and second non-planar washers exerting an evenly distributed compression force biasing said heating element electrical terminal pad towards said conductive strip, said compression force forming an annular electrical contact compression region at the contact between said heating element electrical terminal pad and said conductive strip, said first and second non-planar washers distributing the compression force exerted by said first and second fastener heads evenly to establish said annular electrical contact region surrounding said fastener body but spaced away from and concentric with said fastener body.

* * * * *